US007700527B2

(12) United States Patent
Fang et al.

(10) Patent No.: US 7,700,527 B2
(45) Date of Patent: Apr. 20, 2010

(54) FOAMING-RESISTANT HYDROCARBON OIL COMPOSITIONS

(75) Inventors: John Zheng Fang, Parsippany, NJ (US); Ming Zhao, East Longmeadow, MA (US)

(73) Assignee: Cytec Surface Specialties, Stamford, CT (US)

( * ) Notice: Subject to any disclaimer, the term of this patent is extended or adjusted under 35 U.S.C. 154(b) by 865 days.

(21) Appl. No.: 11/411,618

(22) Filed: Apr. 26, 2006

(65) Prior Publication Data

US 2007/0254819 A1 Nov. 1, 2007

(51) Int. Cl.
*C10M 145/14* (2006.01)

(52) U.S. Cl. ..... 508/469; 508/458; 508/463; 508/504; 508/524; 508/533; 508/589; 508/590

(58) Field of Classification Search ..... 508/469
See application file for complete search history.

(56) References Cited

U.S. PATENT DOCUMENTS 3,166,508 A 1/1965 Fields
6,143,806 A * 11/2000 Kato et al. ..... 523/160
6,391,984 B1 5/2002 Grolitzer et al.
6,667,373 B2 12/2003 Grolitzer et al.
2004/0087742 A1 5/2004 Grolitzer et al.

FOREIGN PATENT DOCUMENTS

EP 1 029 030 8/2000
WO WO- 99/20721 4/1999

* cited by examiner

*Primary Examiner*—Glenn A Caldarola
*Assistant Examiner*—Taiwo Oladapo
(74) *Attorney, Agent, or Firm*—Connolly Bove Lodge & Hutz LLP

(57) ABSTRACT

A composition of matter resistant to foaming comprising a hydrocarbon oil and an acrylate copolymer dispersed in the said hydrocarbon oil, which acrylated copolymer contains at last one polymerised fluorinated (meth)acrylate monomer wherein not more than three neighbouring carbon atoms in the said fluorinated (meth)acrylate monomer carry one or more fluorine substituents.

9 Claims, No Drawings

FOAMING-RESISTANT HYDROCARBON OIL COMPOSITIONS

FIELD OF THE INVENTION

This invention relates to foaming-resistant hydrocarbon oil compositions, and more particularly to a polymeric anti-foaming agent in such oil.

BACKGROUND OF THE INVENTION

Suppression of foam generated in using hydrocarbon oils is of major importance, additives in small effective amounts in such oils being widely used for this purpose. Customary additives are the acrylate polymers as disclosed in U.S. Pat. No. 3,166,508 to Fields. As is noted there, other additives in such oils used to improve oil-related performance can aggravate the tendency to foam, and a continuing need exists to inhibit such undesirable foaming over a wide range of use conditions, particularly in new hydrocarbon oil formulations. Foam-reducing agents comprising fluorine-containing acrylate copolymers with longer-chain fluorinated alkyl acrylates as comonomers as have been known, i. a. from EP 1 029 030 B1. As there is a concern regarding the bio-accumulation of longer-chain fluorinated compounds, such as those comprising perfluoro octyl moieties, there is a need to provide anti-foaming agents that do not exhibit similar bio-accumulation.

SUMMARY OF THE INVENTION

Improved hydrocarbon oil compositions have been developed with enhanced resistance to foaming. Accordingly, a principal object of this invention is to provide compositions of hydrocarbon oil which resist foaming over a wide range of use conditions. Another object is to provide an acrylate polymer anti-foaming agent for use in such improved foaming-resistant compositions, which acrylate polymer does not show any propensity to bio-accumulation. Other objects of this invention will in part be obvious and will appear from the following description and claims. These and other objects are accomplished by providing a composition of matter resistant to foaming comprising a hydrocarbon oil having a tendency to foam and a foam-inhibiting amount dispersed in the hydrocarbon oil of an acrylate copolymer containing at least one polymerised fluorinated alkyl(meth)acrylate monomer wherein not more than three neighbouring carbon atoms carry one or more fluorine substituents.

When reference is made to (meth)acrylates in the context of this invention, this expression shall encompass both acrylates and methacrylates. When reference is made to an acrylate copolymer, this is deemed to encompass all copolymers having a mass fraction of at least 20% of moieties derived from (meth)acrylate monomers.

DETAILED DESCRIPTION OF THE PREFERRED EMBODIMENTS

Fluorine in acrylate copolymer anti-foaming additives significantly improves resistance to foaming of hydrocarbon oils. Such fluorine is provided by the presence of at least one polymerised fluorinated (meth)acrylate as a monomer component of the acrylate copolymer. The amount of such bound fluorine in the acrylate copolymer effective to inhibit foaming varies with the composition or formulation of the hydrocarbon oil in which the acrylate copolymer is dispersed. A mass fraction of fluorine in the acrylate copolymer of up to about 30% is generally adequate as anti-foaming agent for most hydrocarbon oils, with mass fractions of from about 0.10% to about 10% being preferred, and mass fractions of from about 0.50% to 5% being most preferred. The amount of the at least one fluorinated (meth)acrylate monomer is preferably chosen such that the mass fraction of the said at least one fluorinated (meth)acrylate monomer in the acrylate copolymer is from 0.1% to 10%.

Fluorinated (meth)acrylate monomers used in the synthesis of the said acrylate copolymers are preferably esters of acrylic or methacrylic acids with fluorinated alkanols, which alkanols may be linear or branched, and may also comprise hetero atoms such as oxygen, nitrogen or sulphur. These alkanols may not have more than two adjacent carbon atoms which carry at least one fluorine atom. The at least one fluorinated (meth)acrylate monomer in the acrylate copolymer has not more than three, preferably not more than two, neighbouring carbon atoms in the alkyl group which carry one or more fluorine atom. This means that in the alkyl chain, there may be moieties like $$—CF_2—CF_2—CF_2— \text{ or } —CF_2—CF_2— \text{ or } —CF_2— \text{ or}$$

$$—CFR^1—CFR^2—CFR^3— \text{ or } —CFR^4—CFR^5— \text{ or } —CFR^6—$$

where carbon atoms directly bound to these moieties may not carry fluorine substituents, $R^1$ to $R^7$ standing for aryl groups, alkoxy groups, acyl groups, and alkyl groups that do not carry fluorine atoms in the carbon atom immediately adjacent to the binding site. Sequences with more than three sequential $—CF_2—$ groups or $—CFR^7—$ groups are ruled out. The fluorinated (meth)acrylate monomers that can be used in the synthesis of the said acrylate copolymers are preferably selected from the group consisting of 2,2,2-trifluoroethyl(meth)acrylate, 3,3,3-trifluoropropyl(meth)acrylate, 2,2,3,3,3-pentafluoropropyl(meth)acrylate, 2,2,2-trifluoroisopropyl(meth)acrylate and 2,2,2,-2',2',2'-hexafluoroisopropyl(meth)-acrylate, with trifluoroethyl(meth)acrylate being particularly preferred. Especially preferred in the context of the present invention is trifluoroethyl methacrylate.

The said at least one fluorinated (meth)acrylate monomer is copolymerised with at least one non-fluorinated olefinically unsaturated monomer, such as an alkyl acrylate in which the alkyl radical is linear, branched or cyclic and has from 1 to 18 carbon atoms, an alkyl methacrylate in which the alkyl radical is linear, branched or cyclic and has from 1 to 18 carbon atoms, an alkyl or dialkyl ester of maleic or fumaric acid in which the alkyl radical is linear, branched or cyclic and has from 1 to 18 carbon atoms, a vinyl ester of an aliphatic carboxylic acid having from two to twenty carbon atoms, an alkyl vinyl ether in which the alkyl radical is linear, branched or cyclic and has from 1 to 18 carbon atoms, and an alkyl vinyl ketone in which the alkyl radical is linear, branched or cyclic and has from 1 to 18 carbon atoms, styrene and a substituted styrene such as vinyl toluene.

Of these comonomers, the first-named alkyl acrylates are particularly preferred, and a mass fraction of moieties derived therefrom of at least 50% in the copolymer is especially preferred. It is preferred to use an acrylic ester of an alkanol which is linear or branched, and has from two to ten carbon atoms, such as ethyl acrylate, n-propyl acrylate, n-butyl acrylate, sec. butyl acrylate, 1- and 2-hexyl acrylate, 1-octyl acrylate, 2-ethylhexyl acrylate, and 1-decyl acrylate. Mixtures of such esters are particularly preferred, such as mixtures of ethyl acrylate and 2-ethylhexyl acrylate.

The molar mass (weight average $M_w$) of the acrylate copolymer defoaming agent can vary within broad limits and is generally from about 10,000 g/mol to about 250,000 g/mol (from 10 kg/mol to 250 kg/mol), preferably about 20,000 g/mol to 100,000 g/mol (from about 20 kg/mol to 100 kg/mol). At very high molar masses of in excess of 250 kg/mol, the acrylate copolymer tends to settle out in many hydrocarbon oils and lose its defoaming effectiveness which relies on being finely dispersed in the oil. If $M_w$ is lower than about 10 kg/mol it tends to dissolve in, and form the same phase as, the oil and therefore cannot be a defoamer. The acrylate copolymer antifoaming agents containing polymerised fluorinated (meth)acrylate monomer are effective at very low concentrations in the hydrocarbon oil, i. e. at a mass fraction of less than about 1500 mg/kg ("1500 ppm"). Mass fractions of from 20 mg/kg to 500 mg/kg are preferred, but this may be varied depending upon the nature of the oil, mass fractions less than 200 mg/kg by weight usually being sufficient. Heavy oils and oils containing foam-inducing adjuvants require more of the acrylate copolymer defoaming agent than do base oils with lesser foaming characteristics.

The acrylate copolymer defoaming agents are preferably added to the hydrocarbon oil as a solution in a hydrocarbon solvent. The foaming-inhibiting effect of the acrylate copolymers is not materially affected by the presence of other adjuvants in the hydrocarbon oil. Since the acrylate copolymers are present in the oils in only very small quantities, the use in the oil of very acidic or very basic adjuvants has substantially no effect on performance of the antifoam additives. Compositions of hydrocarbon oils containing the present defoaming agents are storage-stable over long time periods and also when subjected to heat and pressure during operating use conditions. Hydrocarbon oils rendered substantially foaming-resistant by incorporating a foam-inhibiting quantity of the present anti-foaming acrylate copolymers are synthetic or petroleum stocks of varying viscosities such as lubricating oils for internal combustion engines and motors, diesel fuels, lubricants and pressure transfer media, e. g., industrial lubricants, process oils, hydraulic oils, turbine oils, spindle oils, journal bearing oils, pneumatic tool lubricants, etc. They may be synthetic or natural hydrocarbons of any type, i. e. paraffinic, naphthenic, aromatic or blended.

The acrylate copolymers of the invention are prepared by mass, emulsion or solution polymerisation in the presence of a free-radical catalyst and, optionally, known polymerisation regulators (chain transfer agents). When mass polymerised, mixtures of monomers and free-radical catalyst are agitated at 35° C. to 150° C. until polymerisation is substantially complete. In emulsion polymerisation, an emulsion of monomers in an aqueous solution with suitable emulsifying agents such as soap or alkyl-substituted sulfosuccinate is polymerised at from 25° C. to the boiling temperature of water. In solution polymerisation, the monomers are dissolved in an inert liquid, and the solution is agitated in the presence of a catalyst at from 25° C. to the boiling temperature of the solution. Solvents are generally substantially neutral organic liquids which are not affected during the polymerisation process, e. g. aliphatic, aromatic alkyl aromatic or alicyclic hydrocarbons such as hexane, benzene, ethylbenzene or cyclohexane; ketones such as methyl ethyl ketone or acetone; esters such as ethyl acetate or methyl propionate; chlorinated hydrocarbons such as carbon tetrachloride or chloroform; ethers such as diethyl ether or dioxane.

Since the polymers are used as oil additives, polymerisation in a solvent with no adverse effect on the hydrocarbon oil facilitates adding the resulting polymer solution directly to the oil without first separating the polymer from the reaction medium. However, at completion of polymerisation if the polymer solution is too viscous for convenient handling, the solvent can be stripped away and the solid polymer redissolved in another solvent in a mass fraction in the resulting solution which is typically from 30% to 60%, providing a less viscous, more readily handled solution tailored for sale to the hydrocarbon oil formulator. Other reasons to change the solvent are to provide one which is more environmentally friendly, is safer in having a higher flash point and/or is less odorous.

Polymerisation of the acrylate polymers can be conducted in the presence of polymerisation modifiers acting on the solubility of the polymers. Such modifiers include chain transfer agents such as alkyl mercaptans, e. g. tert-butyl mercaptan or n-dodecyl mercaptan; the polyhaloalkanes such as carbon tetrachloride, chloroform or bromo-form; the nitroalkanes such as nitroethane or 2-nitropropane; liquid hydrocarbons such as toluene, ethylbenzene, or kerosene, etc. The chain transfer agent may also be the solvent which is used during the reaction or it may be incorporated as an additional solvent, e. g. dioxane, acetone, isopropanol, paraffin hydrocarbons, etc.

Useful catalysts include organic peroxide compounds such as acetyl, benzoyl, lauroyl and stearoyl peroxides and tert.-butyl and cumene hydroperoxides; inorganic peroxo compounds such as hydrogen peroxide, sodium perborate, and potassium persulfate; diazo compounds such as azo-bis-isobutyronitile, alpha, alpha-azodiiso-butyramide, etc.

The polymerisation reaction may be conducted in batch mode, e. g. by agitating the reactants (which are charged initially at once or partially metered in over time during polymerisation) at a temperature of from 80° C. to 150° C. until the reaction is complete, or continuously by constantly removing polymer while replenishing one or more of the monomers, catalyst and chain transfer agent. When operating batchwise the polymeric reaction product is usually separated from the reaction mixture by distilling off solvent and any unreacted starting material. However, as noted, separation may not be necessary when the reaction mixture as a solution of polymer in solvent is used directly as additive to the hydrocarbon oil. The invention is further described in the following illustrative Examples which are not intended to limit the invention. All relative quantities measured in "%" are mass fractions (ratio of the mass of the substance considered and the mass of the mixture).

Example 1

Defoamer with a Mass Fraction of 2,2,2-trifluoroethyl methacrylate in the copolymer of 1%

This example illustrates the preparation of radical solution polymerisation process comprising trifluoroethyl methacrylate:

A 2000 ml glass reactor was initially charged with ethyl acetate (102.7 g) and isopropyl alcohol (25.7 g). The contents were heated to about 80° C. A mixture of ®vazo-64 (2,2'-azobis-2-methylbutyronitrile, E. I., DuPont de Nemours & Co., 1.15 g), ethyl acetate (20.5 g), isopropyl alcohol (5.1 g), ethyl acrylate (103.0 g), 2-ethylhexyl acrylate (320.0 g), and 2,2,2-trifluoroethyl methacrylate (4.05 g) was then gradually added to the reactor during two hours. After addition of the first mixture, the system was held at the set temperature under stirring for one hour. The second mixture, comprising ®vazo-64 (4.02 g), ethyl acetate (39.8 g), isopropyl alcohol (9.9 g), ethyl acrylate (137.0 g), 2-ethylhexyl acrylate (240.0 g), and 2,2,2-trifluoroethyl methacrylate (4.05 g), was then added to the reactor during two hours. The mixture was left to react for another one and a half hours. Solvent, residual monomers, and other by-products from initiation were stripped off. The resulting polymer was then cooled to 65° C. and filtered. A colourless viscous polymer was obtained in a yield of 98.9%. The weight average molar mass was 71,800 g/mol, determined by gel permeation chromatography using polystyrene as standard. The mass fraction of fluorine in the copolymer was 0.34%.

Example 2

Comparative, Defoamer with a Mass Fraction of ®Zonyl TA-N in the copolymer of 1%

Example 1 was repeated, but 2,2,2-trifluoromethacrylate was replaced by the same mass of ®Zonyl TA-N (commercial fluoroalkyl acrylate from E. I. du Pont de Nemours and Company, comprising mass fractions of $C_6F_{13}$—$CH_2$—$CH_2$—O— residues of at most 6%, of $C_8F_{17}$—$CH_2$—$CH_2$—O— residues of (50±3)%, of $C_{10}F_{21}$—$CH_2$—$CH_2$—O— residues of (29±2)%, of $C_{12}F_{25}$—$CH_2$—$CH_2$—O— residues of (11±2) %, and of $C_{14}F_{29}$—$CH_2$—$CH_2$—O— and higher residues of at most 4%). The mass fraction of fluorine in the copolymer was 0.64%.

Example 3

Foaming Resistance

The test method evaluating foaming resistance is a modified form of ASTM D892-92. A hydrocarbon oil sample containing finely dispersed antifoaming agent is blown with air at a constant rate of (94±5) ml/min for 5 min at (24.0±0.5)° C. and then allowed to settle. The volume of foam generated above the oil level is measured, and the time needed to fully collapse the foam is measured. Performance in this phase is recorded under Sequence (abbreviated as "Seq.") I in the following tables. This test is repeated on a second sample at a temperature of (94.0±0.5)° C., with results shown under "Seq. II" in the tables. After the foam from Seq. II has collapsed, the same sample is cooled to 24° C., and the procedure for Seq. I repeated with results shown under "Seq. III". The same sample from Seq. III test is then heated to (153.0±0.5)° C. and the Seq. I procedure is repeated with a higher air flow of (200±5) ml/min, with results of this rather severe high temperature test shown under "Seq. IV".

2.5 g of a solution of the defoaming agent of Example 1 in an aliphatic hydrocarbon solvent (®Shellsol D 40, mixture of $C_9$— to $C_{11}$— paraffins and naphthenes, 40 g of polymer in 100 g of solution) was diluted with further solvent to 50 g. The mass fraction of defoamer in this dilute solution was now 2% (2 g/100 g). 0.8 g of this defoamer solution were added to 200 g of test oil. This test oil blend was vigorously shaken for three minutes to finely disperse the defoamer solution in the oil. Foaming resistance was then measured using different hydrocarbon oil compositions under the various sequences of the noted test method. These hydrocarbon oil composition were prepared by adding a quantity of this test oil blend to the hydrocarbon oil. The test oils used were compositions corresponding to commercial grades of industrial oils, ATM (automatic transmission) fluids, and gear oils, but without defoamer added. Usually, the mass fraction of defoamer (conventional defoamer based on non-fluorinated acrylate copolymers) in such oils is about 200 mg/kg ("200 ppm").

In this test, the hydrocarbon oils used were a commercially available industrial oil, an automatic transmission fluid, and a gear oil, in each case without the usual addition of defoaming agent. The defoaming agent of the invention is the acrylate copolymer of Example 1 ("Ex. 1"). For comparison purposes, a similar composition was prepared using the same mass fraction of the acrylate copolymer of Example 2. "Comp" refers to ®PC-1644, a conventional non-fluorinated polyacrylate defoaming agent, available from Cytec Industries, Inc. The mass fraction w of the defoaming agent in the hydrocarbon oil composition is calculated as the ratio of the mass $m_A$ of the defoaming agent and the mass $m_o$ of the hydrocarbon oil composition, it is measured in "mg/kg" equivalent to "ppm". The volume V of foam as measured is stated in ml (millilitres), and the collapse time t is stated in s (seconds). Testing was done at an extremely low mass fraction of defoaming agent in the hydrocarbon oil composition (30 mg/kg and 50 mg/kg), compared to that ratio which is generally in use (200 mg/kg). The purpose of choosing this low mass fraction was to ascertain any difference between developmental materials and current commercial defoaming agents.

TABLE 1

| Industrial oil | | | | | | | |
|---|---|---|---|---|---|---|---|
| Defoaming agent | | Seq. I | | Seq. II | | Seq. III | |
| Kind | w/(mg/kg) | V/ml | t/s | V/ml | t/s | V/ml | t/s |
| None | | 330 | 192 | 35 | 12 | 300 | 30 |
| Comp. | 30 | 0 | 0 | 20 | 3 | 0 | 0 |
| Ex. 2 | 30 | 0 | 0 | 20 | 0 | 0 | 0 |
| Ex. 1 | 30 | 0 | 0 | 15 | 0 | 0 | 0 |

TABLE 2

| Automatic transmission fluid | | | | | | | | | |
|---|---|---|---|---|---|---|---|---|---|
| Defoaming agent | | Seq. I | | Seq. II | | Seq. III | | Seq. IV | |
| Kind | w/(mg/kg) | V/ml | t/s | V/ml | t/s | V/ml | t/s | V/ml | t/s |
| None | | 440 | 310 | 60 | 41 | 390 | 316 | 550 | 19 |
| Comp. | 50 | 360 | 279 | 50 | 22 | 340 | 276 | 530 | 15 |
| Ex. 2 | 50 | 90 | 24 | 50 | 25 | 180 | 72 | 140 | 12 |
| Ex. 1 | 50 | 40 | 13 | 50 | 33 | 180 | 69 | 100 | 16 |

TABLE 3

| Gear oil | | | | | | | | | |
|---|---|---|---|---|---|---|---|---|---|
| Defoaming agent | | Seq. I | | Seq. II | | Seq. III | | Seq. IV | |
| Kind | w/(mg/kg) | V/ml | t/s | V/ml | t/s | V/ml | t/s | V/ml | t/s |
| None | | 40 | 43 | 360 | 135 | 290 | >300 | 350 | 28 |
| Comp. | 50 | 0 | 0 | 0 | 0 | 0 | 0 | 530 | 41 |
| Ex. 2 | 50 | 0 | 0 | 0 | 0 | 0 | 0 | 260 | 42 |
| Ex. 1 | 50 | 0 | 0 | 0 | 0 | 0 | 0 | 200 | 42 |

The above data illustrates the significant foaming-resistant results in various hydrocarbon oils of the acrylate copolymer defoaming agents of the invention containing a mass fraction of about 0.34% of chemically incorporated fluorine (Example 1) in comparison with the fluorinated acrylate copolymer of example 2 (with a mass fraction of about 0.64% of chemically incorporated fluorine) and a pure (i. e. non-fluorinated) polyacrylate defoaming agent. Comparing with pure polyacrylate defoaming agents, fluorine-containing defoaming agents (ex. 1 and 2) showed much improved high temperature efficiencies as well as general defoaming characteristics. Comparing with the defoaming agent of Example 2 with a bulky fluorine containing moiety having more than three adjacent carbon atoms which bear at least one fluorine substituent, the acrylate copolymer defoaming agent of example 1 comprises a short chain fluorinated monomer, having not more than three adjacent carbon atoms which bear at least one fluorine substituent. Unexpectedly, such acrylate copolymers exhibit an even better high temperature defoaming performance and improved shelf life stability in hydrocarbon oils containing the said defoaming agent, as compared to defoaming agents comprising the afore-mentioned longer-chain fluorinated materials.

What is claimed is:

1. A composition of matter resistant to foaming comprising a hydrocarbon oil and an acrylate copolymer dispersed in the said hydrocarbon oil, which acrylate copolymer contains at least one polymerised fluorinated methacrylate monomer wherein the said at least one fluorinated methacrylate monomer in the acrylate copolymer is selected from the group consisting of 2,2,2-trifluoroethyl methacrylate, 3,3,3-trifluoropropyl methacrylate, 2,2,3,3,3-penta-fluoropropyl methacrylate, 2,2,2-trifluoroisopropyl methacrylate and 2,2, 2,2', 2'-hexafluoroisopropyl methacrylate.

2. The composition of matter of claim 1, wherein the said at least one fluorinated methacrylate monomers is copolymerised with at least one non-fluorinated olefinically unsaturated monomer selected from the group consisting of alkyl acrylates in which the alkyl radical is linear, branched or cyclic and has from 1 to 18 carbon atoms, alkyl methacrylates in which the alkyl radical in which the alkyl radical is linear, branched or cyclic and has from 1 to 18 carbon atoms, alkyl esters of maleic and fumaric acids in which the alkyl radical is linear, branched or cyclic and has from 1 to 18 carbon atoms, vinyl esters of aliphatic carboxylic acids having from two to 20 carbon atoms, alkyl vinyl ethers and alkyl vinyl ketones in which the alkyl radical is linear, branched or cyclic and has from 1 to 18 carbon atoms, styrene and substituted styrenes.

3. The composition of matter of claim 2, wherein in the said acrylate copolymer, the mass fraction of the said at least one alkyl acrylate in which the alkyl radical is linear, branched or cyclic and has from 1 to 18 carbon atoms is at least 50%.

4. The composition of matter of claim 1, wherein the mass fraction of fluorine in the said acrylate copolymer is from 0.1% to 5%.

5. The composition of matter of claim 1, wherein the fluorinated methacrylate monomer is 2,2,2-trifluoroethyl methacrylate.

6. The composition of matter of claim 3, wherein the said at least one alkyl acrylate is are selected from the group consisting of ethyl acrylate, 2-ethylhexyl acrylate, and mixtures of these.

7. The composition of matter of claim 1, wherein the weight-average molar mass of the acrylate copolymer is from 20 kg/mol to 100 kg/mol.

8. The composition of matter of claim 1, wherein the mass fraction of the acrylate copolymer in the mixture with the hydrocarbon oil is from 20 mg/kg to 500 mg/kg.

9. The composition of matter of claim 1, wherein the mass fraction of the said at least one fluorinated methacrylate monomer in the acrylate copolymer is from 0.1% to 10%.

* * * * *

UNITED STATES PATENT AND TRADEMARK OFFICE

CERTIFICATE OF CORRECTION

PATENT NO. : 7,700,527 B2
APPLICATION NO. : 11/411618
DATED : April 20, 2010
INVENTOR(S) : John Zheng Fang et al.

It is certified that error appears in the above-identified patent and that said Letters Patent is hereby corrected as shown below:

In the Claims:

In Claim 1, lines 9-10 (column 7, line 20-21) delete "2,2, 2,2',2'-hexafluoroisopropyl" and insert -- 2,2,2,2',2',2'-hexafluoroisopropyl --.

Signed and Sealed this

First Day of June, 2010

David J. Kappos

David J. Kappos
*Director of the United States Patent and Trademark Office*